US011337525B1

(12) United States Patent
Wu et al.

(10) Patent No.: US 11,337,525 B1
(45) Date of Patent: May 24, 2022

(54) RECLINING SEATBACK SUPPORT DEVICE

(71) Applicant: COMFORDY CO., LTD., Tainan (TW)

(72) Inventors: Yu-Ling Wu, Tainan (TW); Armin Roland Sander, Fürth (DE); Luca Mazzon, Senna Comasco (IT)

(73) Assignee: Comfordy Co., Ltd., Tainan (TW)

( * ) Notice: Subject to any disclaimer, the term of this patent is extended or adjusted under 35 U.S.C. 154(b) by 0 days.

(21) Appl. No.: 17/230,262

(22) Filed: Apr. 14, 2021

(51) Int. Cl.

| | |
|---|---|
| ***A47C 7/40*** | (2006.01) |
| ***A47C 7/44*** | (2006.01) |
| ***A47C 7/46*** | (2006.01) |
| ***A47C 7/48*** | (2006.01) |
| ***A47C 1/032*** | (2006.01) |
| ***A47C 1/02*** | (2006.01) |

(52) U.S. Cl.

CPC ..... *A47C 7/448* (2013.01); *A47C 1/02* (2013.01); *A47C 1/03261* (2013.01); *A47C 1/03274* (2018.08); *A47C 1/03277* (2013.01); *A47C 1/03288* (2013.01); *A47C 7/40* (2013.01); *A47C 7/445* (2013.01); *A47C 7/46* (2013.01); *A47C 7/462* (2013.01); *A47C 7/48* (2013.01)

(58) Field of Classification Search

CPC ... A47C 1/02; A47C 1/03261; A47C 1/03274; A47C 1/03277; A47C 1/03288; A47C 7/40; A47C 7/44; A47C 7/46; A47C 7/48; A47C 7/462; A47C 7/445; A47C 7/448

USPC ..... 297/285, 291, 296, 297, 301.1, 301.3, 297/354.11, 452.3, 452.31, 452.54, 297/452.15, 230.14

See application file for complete search history.

(56) References Cited

U.S. PATENT DOCUMENTS

| | | | | |
|---|---|---|---|---|
| 2009/0230751 | A1* | 9/2009 | Wu | A47C 7/462 297/452.18 |
| 2011/0298260 | A1* | 12/2011 | Hsuan-Chin | A47C 7/402 297/284.7 |
| 2012/0091774 | A1* | 4/2012 | Su | A47C 7/44 297/354.1 |
| 2012/0228911 | A1* | 9/2012 | Piretti | A47C 7/445 297/285 |
| 2013/0082499 | A1* | 4/2013 | Schmitz | A47C 7/44 297/285 |

(Continued)

FOREIGN PATENT DOCUMENTS

| | | | | |
|---|---|---|---|---|
| CN | 109549386 A | * | 4/2019 | A47C 7/00 |
| JP | 2007-50121 | * | 3/2007 | A47C 1/03255 |

(Continued)

*Primary Examiner* — Robert Canfield

(74) *Attorney, Agent, or Firm* — Rosenberg, Klein & Lee

(57) ABSTRACT

A reclining seatback support device which mainly includes at least one seatback support and a seatback body is revealed. The seatback body and an upper end of the seatback support are provided with pivot bracket portions pivotally connected to each other while a lower part of the seatback body and the seatback support are connected by a swing arm. When a user is sitting and lying down on the back, the seatback body is rotated around the pivot axis where the seatback body is pivotally connected to the upper end of the seatback support and then reclined at a certain angle. By elastic segments of the seatback body and the swing arm between the lower part of the seatback body and the seatback support for pulling and limiting the seatback body, the user can lean on the seatback body comfortably and safely.

4 Claims, 5 Drawing Sheets

(56) References Cited

U.S. PATENT DOCUMENTS

| | | | | |
|---|---|---|---|---|
| 2020/0268154 | A1* | 8/2020 | Serena | A47C 7/285 |
| 2021/0204699 | A1* | 7/2021 | Deevers | A47C 7/38 |

FOREIGN PATENT DOCUMENTS

| | | | | |
|---|---|---|---|---|
| KR | 10-2023461 | * | 9/2019 | A47C 7/445 |
| TW | M479074 U | * | 6/2014 | A47C 7/448 |

* cited by examiner

RECLINING SEATBACK SUPPORT DEVICE

BACKGROUND OF THE INVENTION

Field of the Invention

The present invention relates to a reclining seatback support device, especially to a reclining seatback support device in which a seatback body is able to be adjusted to the desired angle easily and attached to user's lower back smoothly for sitting in comfort.

Description of Related Art

Generally, chairs not only for sitting but also for reclining with so that users can adjust the backrest to the desired reclining angle and leaning against the backrest for rest when they feel tired during the work. However, most of the backrest is made of hard materials and lack of elasticity. Thus the user's back is unable to be attached to the backrest of the chair smoothly while leaning against the chair and this leads to low-back pain and discomfort after a long period of sitting.

SUMMARY OF THE INVENTION

Therefore it is a primary object of the present invention to provide a reclining seatback support device in which a seatback body can be adjusted to the desired angle easily and attached to user's lower back smoothly for sitting in comfort.

In order to achieve the above objects, a reclining seatback support device according to the present invention mainly includes at least one seatback support and a seatback body. The seatback body and an upper end of the seatback support are provided with pivot bracket portions pivotally connected to each other while a lower part of the seatback body and the seatback support are connected by a swing arm. When a user is sitting and lying down on the back, the seatback body is rotated around the pivot axis where the seatback body is pivotally connected to the upper end of the seatback support and then reclined at a certain angle. By the swing arm between the lower part of the seatback body and the seatback support for pulling and limiting the seatback body, the seatback body is reclined at the desired angle and the user can lean on the seatback body safely. Moreover, the user's lower back can lean on the seatback body smoothly and get comfortable support by an elastic segments formed on a rod portion on each of two sides of the seatback body. Therefore the user is sitting in comfort.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
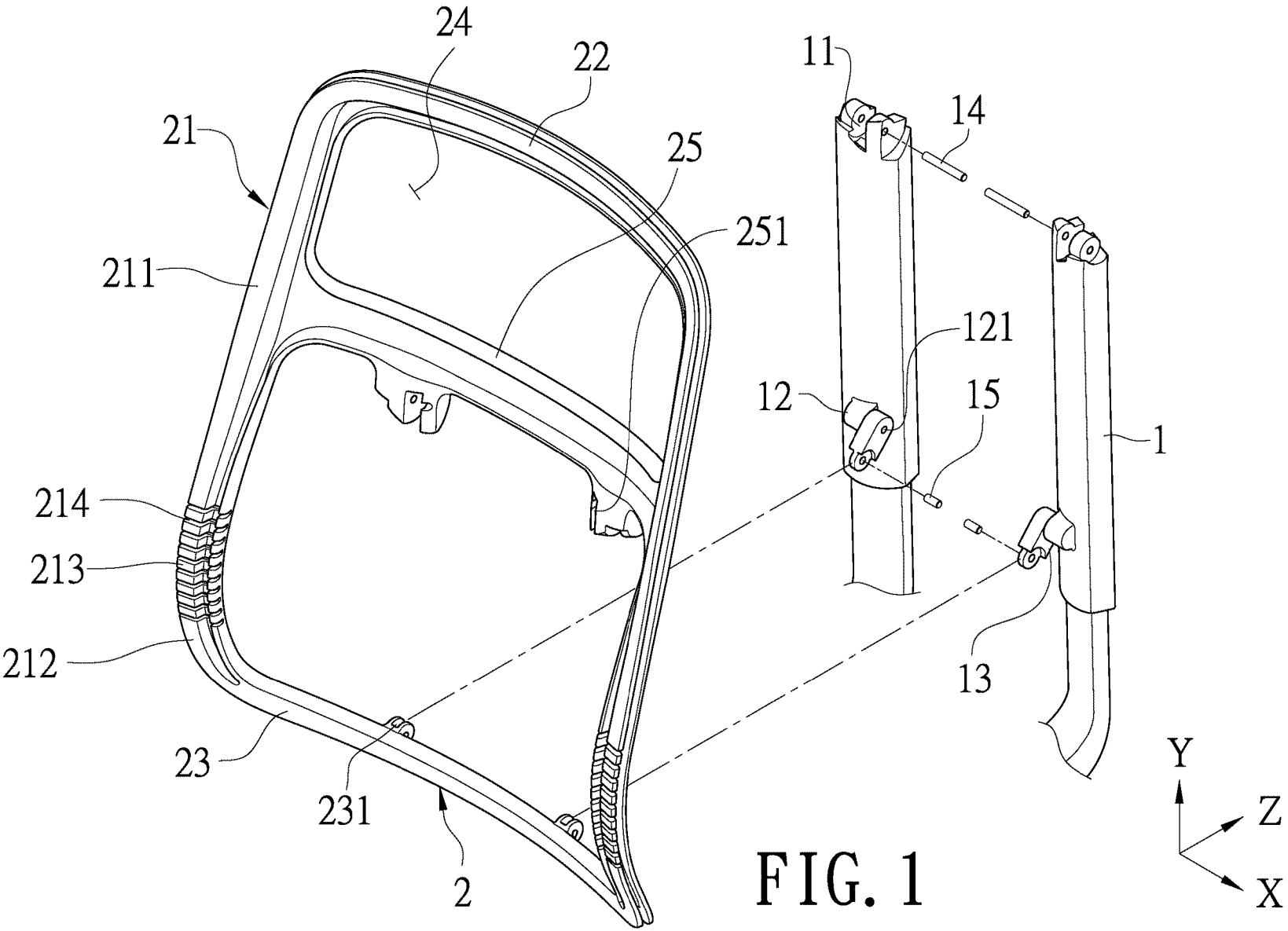
FIG. 1 is an exploded view of an embodiment according to the present invention.

Refer to FIG. 1, a reclining seatback support device according to the present invention mainly includes at least one seatback support 1 and a seatback body 2.

In the embodiment shown in FIG. 1, there are two seatback supports 1, a right one and a left one disposed opposite to each other, each of which includes a first pivot bracket portion 11 on an upper end, a first pivot portion 12 disposed under the first pivot bracket portion 11, and a swing arm 13 with one end pivotally connected to the first pivot portion 12 by a pin shaft 121 inserted through the first pivot portion 12 and the end of the swing arm 13.

The seatback body 2 consists of two first rod portions 21 arranged vertically on a left and a right sides, a second rod portion 22, a third rod portion 23, a hollow portion 24, and a fourth rod portion 25. The second rod portion 22 and the third rod portion 23 are disposed horizontally on an upper part and a lower part of the seatback body 2 respectively and opposite to each other. Both two ends of the second rod portion 22 and two ends of the third rod portion 23 are connected to the two first rod portions 21 correspondingly. The hollow portion 24 is formed among the first rod portions 21, the second rod portion 22, and the third rod portion 23 which are connected to one another. The fourth rod portion 25 is disposed horizontally within the hollow portion 24 and the two ends of the fourth rod portion 25 are connected to the two first rod portions 21 correspondingly. The fourth rod portion 25 is provided with at least one second pivot bracket portion 251. In this embodiment, the fourth rod portion 25 includes a left second pivot bracket portion 251 and a right second pivot bracket portion 251 opposite to each other and each of which is pivotally connected to the first pivot bracket portion 11 of the seatback support 1 correspondingly by a rotary shaft 14 inserted through the first pivot bracket portion 11 and the second pivot bracket portion 251. The third rod portion 23 is provided with at least one second pivot portion 231. In this embodiment, a left second pivot portion 231 and a right second pivot portion 231 are arranged at the third rod portion 23 and opposite to each other. Each of the second pivot portions 231 is pivotally connected to the other end of the swing arm 13 by a pivot shaft 15 inserted through the second pivot portion 231 and the other end of the swing arm 13 while the swing arm 13 is already pivotally connected to the seatback support 1. The direction of the rotary shaft 14 being inserted through the first pivot bracket portion 11 and the second pivot bracket portion 251, the direction of the pin shaft 121 being inserted through the first pivot portion 12 and one end of the swing arm 13, and the direction of the pivot shaft 15 being inserted through the second pivot portion 231 and the other end of the swing arm 13 are all along the X axis (the same direction). Each of the first rod portions 21 is composed of a tilt-down segment 211 inclined downward, a tilt-up segment 212 inclined upward, and an elastic segment 213 provided with a plurality of cut grooves 214. The tilt-down segment 211 and the tilt-up segment 212 are connected by the elastic segment 213 which is curved and located between the third rod portion 23 and the fourth rod portion 25. The elasticity of the elastic segment 213 is generated due to the cut grooves 214 formed thereon.

Figure 2:
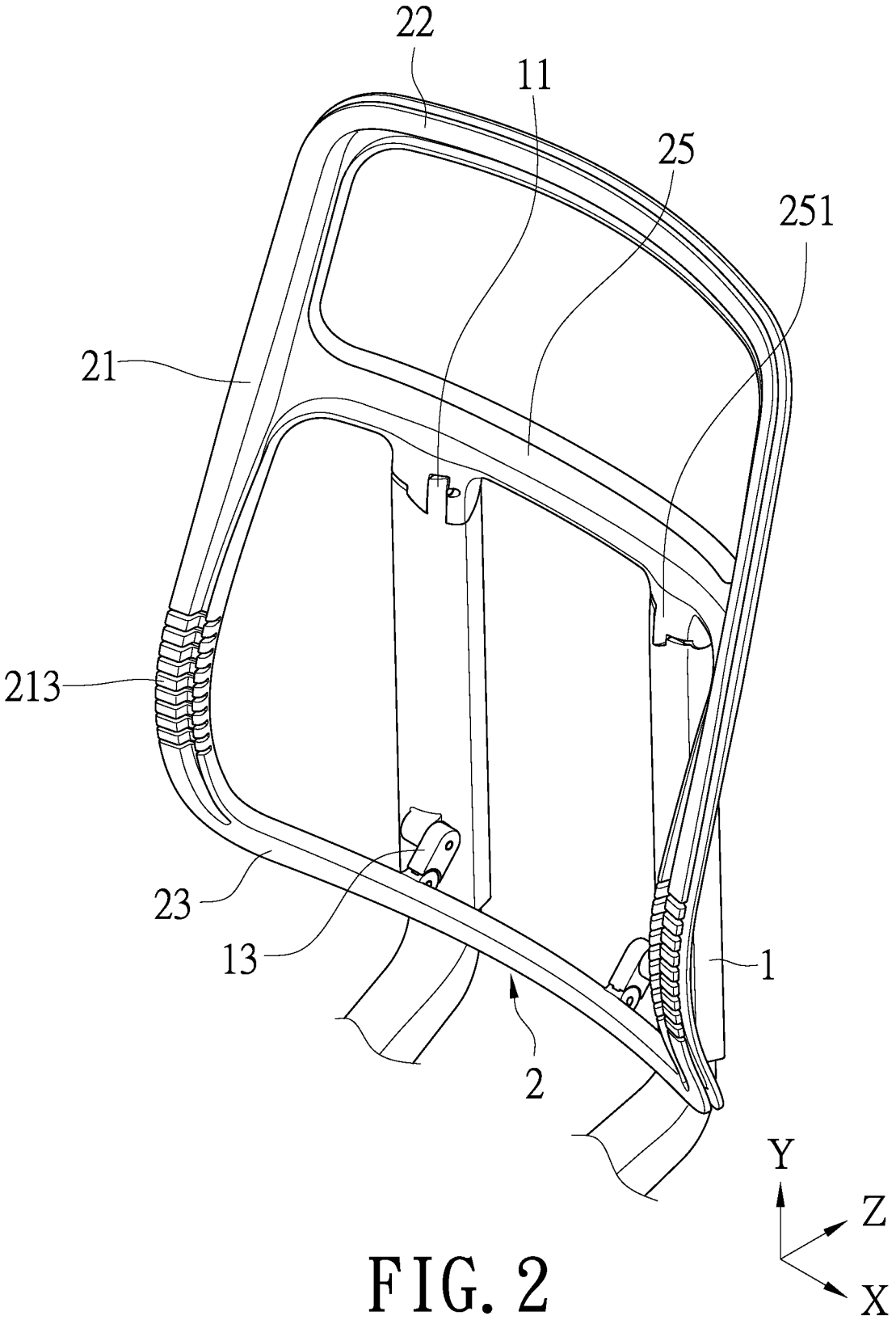
FIG. 2 is a perspective view of an embodiment according to the present invention.

Refer to FIG. 1 and FIG. 2, while being assembled, the seatback body 2 is set in front of the seatback support 1 and each of the second pivot bracket portions 251 of the fourth rod portion 25 is pivotally connected to the first pivot bracket portion 11 on the upper end of the seatback support 1 corresponding by the rotary shaft 14 inserted through the first pivot bracket portion 11 and the second pivot bracket portion 251. Each of the swing arms 13 is located between the second pivot portion 231 of the third rod portion 23 of the seatback body 2 and the first pivot portion 12 of the seatback support 1, so that the first pivot portion 12 of each of the seatback supports 1 is pivotally connected to one end of the swing arm 13 by the pin shaft 121, and the other end of the swing arm 13 is pivotally connected to the second pivot portions 231 of the seatback body 2 by the pivot shaft 15. Accordingly, the seatback body is connected to the seatback support 1 by the two swing arms 13.

Figure 3:
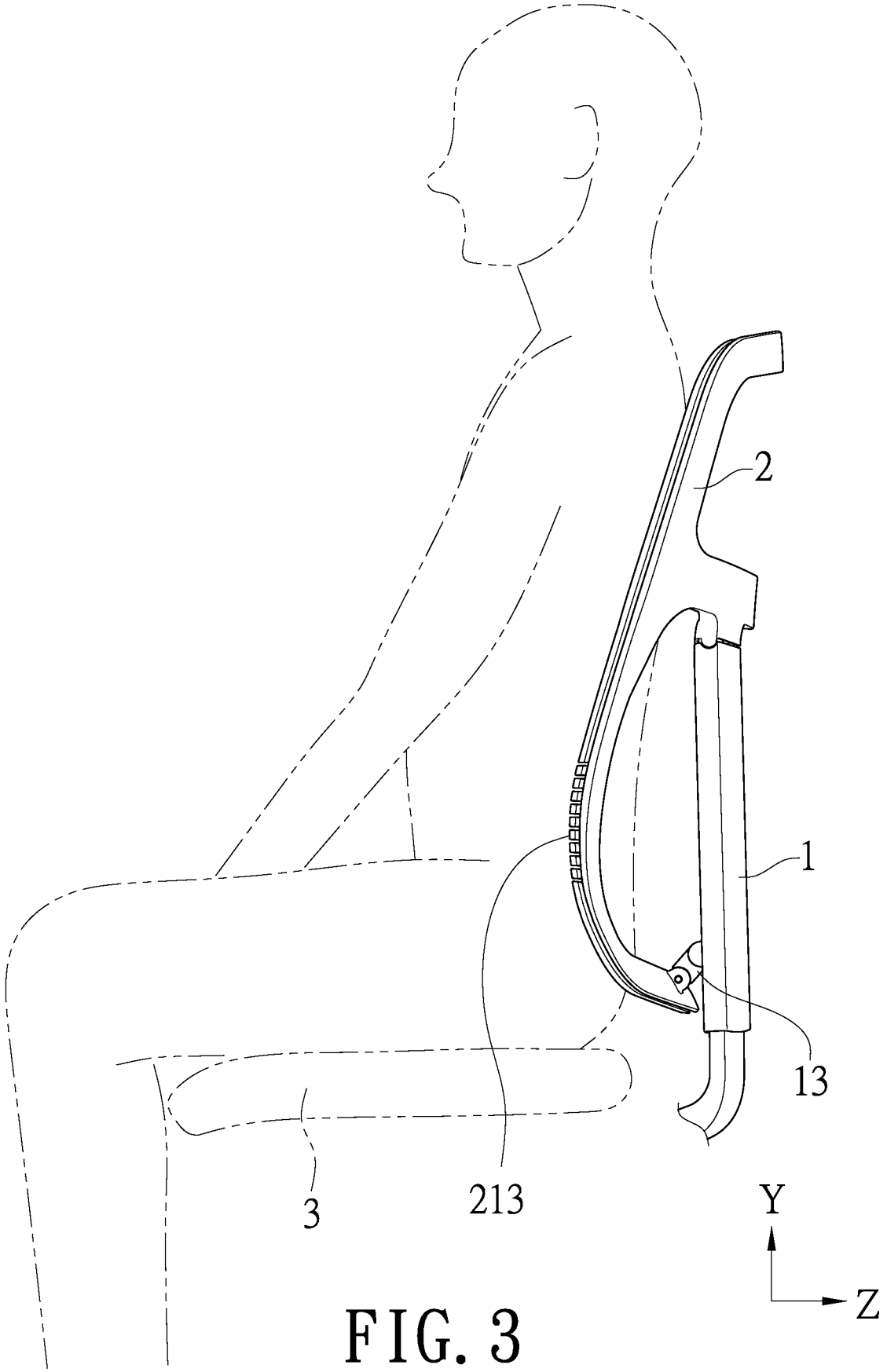
FIG. 3 is a schematic drawing showing an embodiment in use according to the present invention.
Figure 4:
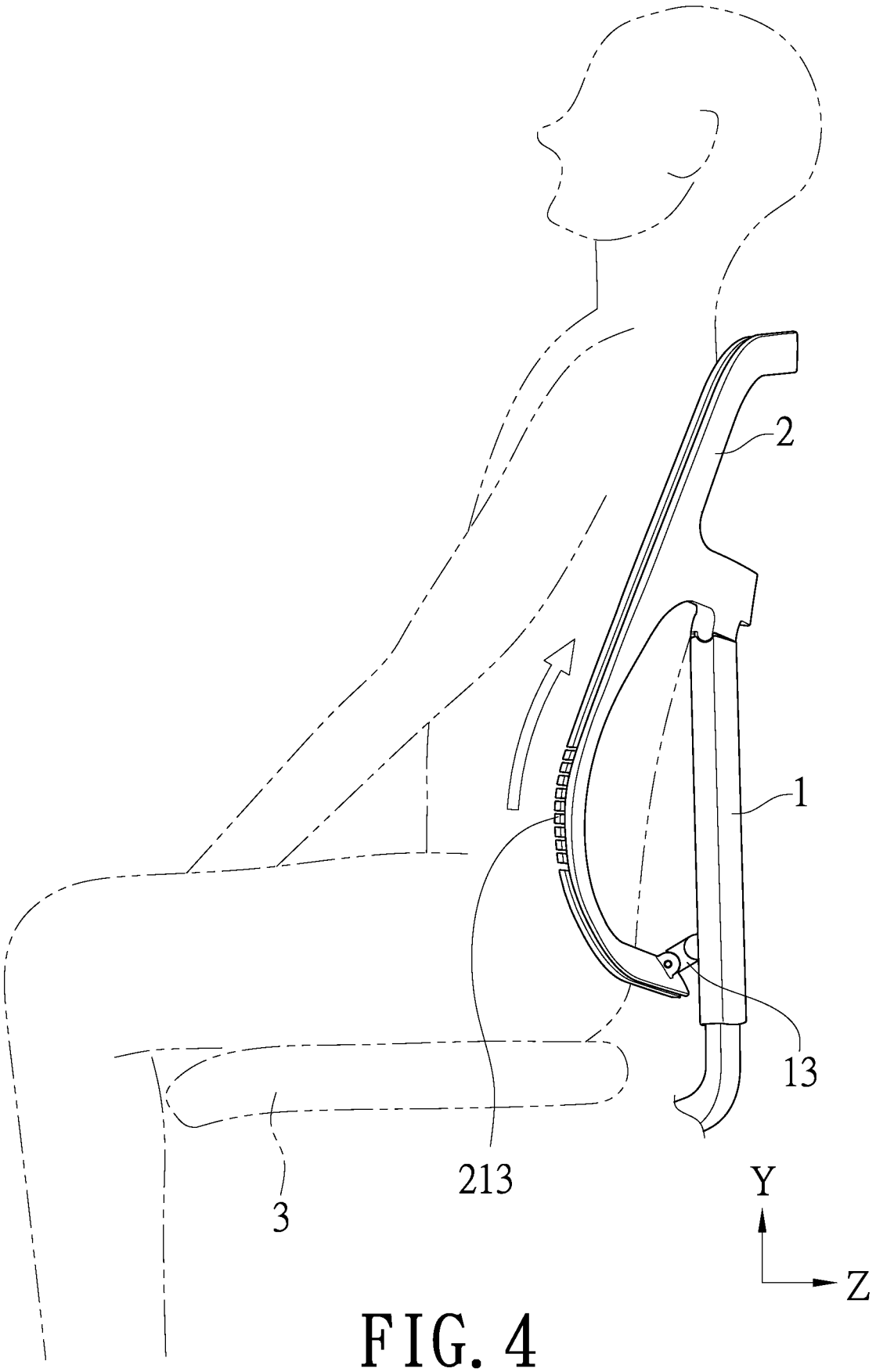
FIG. 4 is another schematic drawing showing an embodiment in use according to the present invention.
Figure 5:
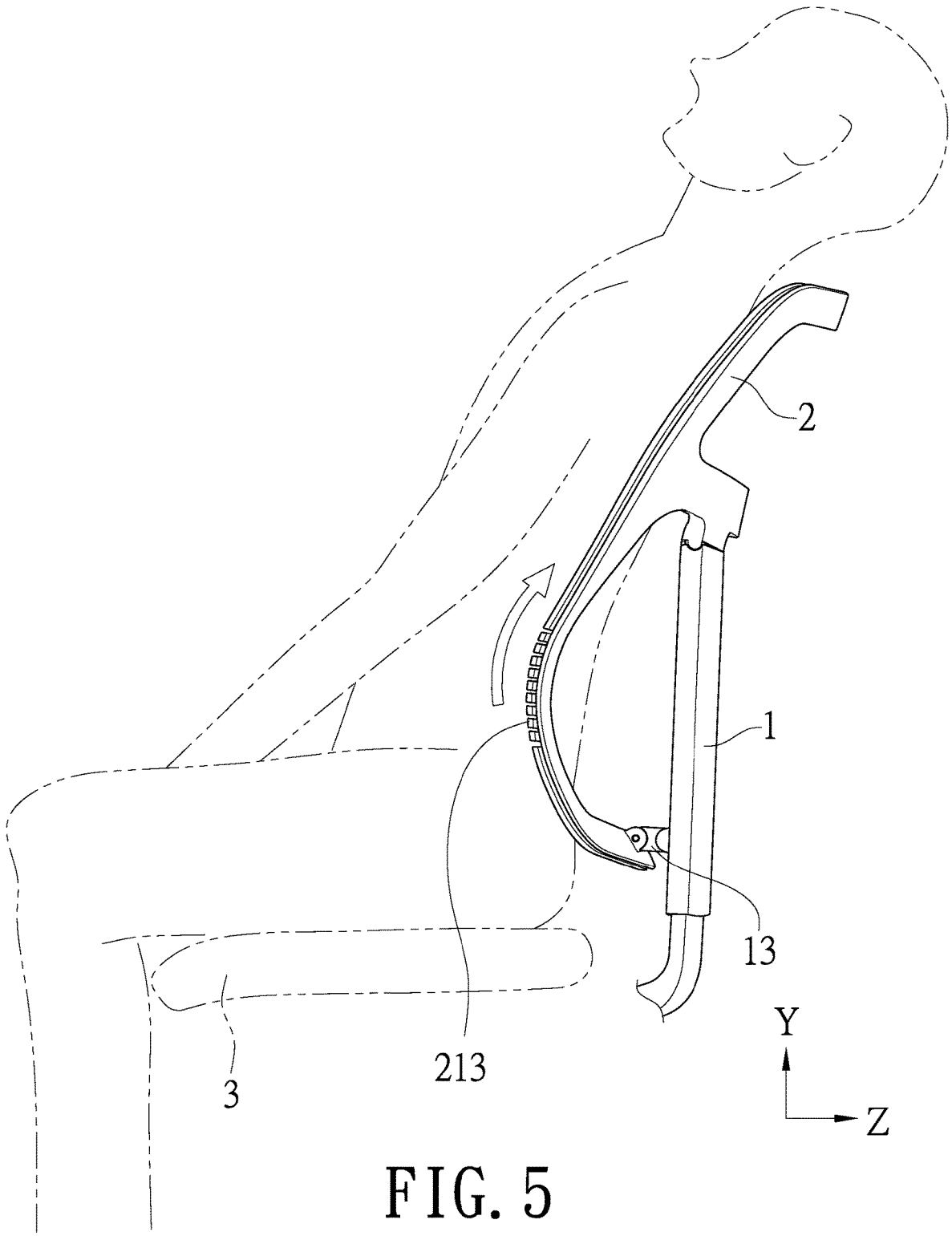
FIG. 5 is a further schematic drawing showing an embodiment in use according to the present invention.

Owing to that the direction of the rotary shaft 14 inserted through the first pivot bracket portion 11 and the second pivot bracket portion 251, the direction of the pin shaft 121 inserted through the first pivot portion 12 and one end of the swing arm 13, and the direction of the pivot shaft 15 inserted through the second pivot portion 231 and the other end of the swing arm 13 are all along the X axis, the first pivot bracket portion 11 and the second pivot bracket portion 251 are limited to rotate and swing on the Z axis, the same as the direction which the swing arm 13 swings along. Refer to FIG. 3, a user is sitting on a seat 3 of a chair with the present reclining seatback support and lying down on the back. Also refer to FIG. 4, the seatback body 2 is rotated around the pivot axis where the fourth rod portion 25 is pivotally connected to the upper end of the seatback support 1 and further tilted back at a desired angle according to the force the user's back applied to the seatback body 2. Also refer to FIG. 5, the design of the swing arm 13 pivotally connected between the third rod portion 23 on lower part of the seatback body 2 and the seatback support 1 is for pulling and limiting the seatback body 2 so that the seatback body 2 is reclined at the desired angle and the user can lean on the seatback body 2 safely.

Moreover, the elastic segment 213 on each of the first rod portions 21 of the seatback body 2 allows the seatback body 2 to have certain elastic deformation under the effect of the force the user's back applied to the seatback body 2. Thus the user's lower back can lean on the seatback body 2 smoothly and get comfortable support no matter what angle the seatback body 2 is reclined. Therefore the user will not have lower back soreness even sitting on the chain for a long period of time.

According to the above embodiments, it is learned that the present invention has the following advantages:

1. In the present reclining seatback support device, the seatback body and the seatback support are pivotally connected to each other by the pivot bracket portions. Thereby the seatback body is tilted back at a desired angle according to the force the user's back applied to the seatback body. By the swing arm connected between the lower part of the seatback body and the seatback support for pulling and limiting the seatback body, the user can lean on the seatback body safely.

2. The elastic segment on each of the two first rod portions on two sides of the seatback body allows the seatback body to have certain elastic deformation. Thus the seatback body supports the user's lower back smoothly and the user sits comfortably no matter what angle the seatback body is reclined.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A reclining seatback support device comprising at least one seatback support which includes a first pivot bracket portion arranged at an upper end, a first pivot portion disposed under the first pivot bracket portion, and a swing arm having one end pivotally connected to the first pivot portion by a pin shaft inserted through the first pivot portion and the end of the swing arm; and a seatback body which includes two first rod portions arranged vertically on a left and a right side thereof, a second rod portion, a third rod portion, a hollow portion, and a fourth rod portion;

wherein the second rod portion and the third rod portion are disposed horizontally on an upper part and a lower part of the seatback body respectively and opposite to each other; both two ends of the second rod portion and two ends of the third rod portion are connected to the two first rod portions correspondingly;

wherein the hollow portion is formed among the first rod portions, the second rod portion, and the third rod portion which are connected to one another;

wherein the fourth rod portion is disposed horizontally within the hollow portion and provided with at least one second pivot bracket portion while the two ends of the fourth rod portion are connected to the two first rod portions correspondingly; the at least one second pivot bracket portion of the fourth rod portion is pivotally connected to the first pivot bracket portion of the seatback support correspondingly by a rotary shaft inserted through the first pivot bracket portion and the at least one second pivot bracket portion; wherein the third rod portion is provided with at least one second pivot portion which is pivotally connected to the other end of the swing arm by a pivot shaft inserted through the at least one second pivot portion and the other end of the swing arm;

wherein the direction of the rotary shaft being inserted through the first pivot bracket portion and the at least one second pivot bracket, the direction of the pin shaft being inserted through the first pivot portion and one end of the swing arm, and the direction of the pivot shaft being inserted through the at least one second pivot portion and the other end of the swing arm are all the same;

wherein an elastic segment is formed on each of the two first rod portions and located between the third rod portion and the fourth rod portion.

2. The device as claimed in claim 1, wherein each of the first rod portions of the seatback body is composed of a tilt-down segment inclined downward and a tilt-up segment inclined upward while the tilt-down segment and the tilt-up segment are connected by the elastic segment.

3. The device as claimed in claim 2, wherein the elastic segment of the first rod portions of the seatback body is provided with a plurality of cut grooves.

4. The device as claimed in claim 1, wherein there are two seatback supports each of which is provided with the first pivot bracket portion disposed on the upper end thereof and the first pivot portion which is arranged under the first pivot bracket portion and pivotally connected to one end of the swing arm; wherein the fourth rod portion is provided with two second pivot bracket portions each of which is pivotally connected to the first pivot bracket portion of the seatback support by a rotary shaft inserted through the first pivot bracket portion and the second pivot bracket portion; the third rod portion is provided with two second pivot portions each of which is pivotally connected to the other end of the swing arm by a pivot shaft inserted through the second pivot portion and the other end of the swing arm.

* * * * *